United States Patent [19]

Cisar et al.

[11] Patent Number: 4,931,092

[45] Date of Patent: Jun. 5, 1990

[54] METHOD FOR PRODUCING METAL BONDED MAGNETS

[75] Inventors: Alan J. Cisar, Sugar Land; Calvin F. Brooks, Angleton, both of Tex.

[73] Assignee: The Dow Chemical Company, Midland, Mich.

[21] Appl. No.: 287,828

[22] Filed: Dec. 21, 1988

[51] Int. Cl.[5] ..... C22C 29/14

[52] U.S. Cl. ..... 75/244; 75/246; 419/12; 419/23; 419/26; 419/27; 419/35; 419/38; 419/64; 428/552; 428/570; 148/101; 148/105; 148/108; 148/120; 148/121; 252/62.55

[58] Field of Search ..... 75/246, 244; 419/38, 419/23, 12, 35, 26, 27, 64; 428/552, 570; 252/62.55; 148/101, 105, 108, 120

[56] References Cited

U.S. PATENT DOCUMENTS

| | | | |
|---|---|---|---|
| 4,431,604 | 2/1984 | Sata et al. | 419/23 |
| 4,597,938 | 7/1986 | Matsuura et al. | 419/23 |
| 4,770,723 | 9/1988 | Sagawa et al. | 148/302 |
| 4,773,950 | 9/1988 | Fujimura et al. | 148/302 |

FOREIGN PATENT DOCUMENTS

| | | |
|---|---|---|
| 62-137809 | 6/1987 | Japan . |

*Primary Examiner*—Stephen J. Lechert, Jr.
*Assistant Examiner*—Nina Bhat

[57] ABSTRACT

A metal-metal matrix composite magnet including a magnetic material such as a neodymium-iron-boron magnetic phase bonded by a metal matrix, preferably copper an a method of making the magnet which involves plating a thin metal layer, for example, a layer having a thickness of less than 1000 angstrom average, from a magnetic phase, pressing the powder, with or without magnetic alignment, into the desired shape and then sintering the pressed powder at a temperature below about 400° C.

34 Claims, No Drawings

METHOD FOR PRODUCING METAL BONDED MAGNETS

BACKGROUND OF THE INVENTION

This invention relates to magnets and a method of producing magnets, and more particularly, to metal-metal matrix composite magnets and a method of producing the composite magnets.

Neodymium-iron-boron ($Nd_2Fe_{14}B$) and its modifications, such as $Nd_2Fe_{14-x}Co_xB$ and $Nd_{2-y}Dy_yFe_{14}B$, are the strongest permanent magnets now known. Typically, these magnets have a strength of up to about 35 MGOe and are useful in applications at temperatures up to 300° C. These magnets are produced by compacting a metallic powder and sintering the particles at temperatures above 700° C., if under pressure, but often above 1000° C. These magnets are difficult and relatively expensive to fabricate. U.S. Pat. No. 4,597,938 describes a process for producing permanent magnet materials.

Polymer-bonded magnets, while not as strong as pure $Nd_2Fe_{14}B$ magnets, can be relatively inexpensively produced. Typically, polymer-bonded magnets have a strength of up to about 8 MGOe and are useful up to a temperature of about 100° C. These magnets are used in applications such as small motors and actuator motors. These magnets are produced by bonding a magnetic material such as $Nd_2Fe_{14}B$ in a polymer matrix.

An alternative to pure $Nd_2Fe_{14}B$ magnets and polymer-bonded magnets are metal-metal matrix composite magnets. Metal-metal matrix composite magnets, like polymer-bonded magnets, are less expensive and less complicated to produce than pure $Nd_2Fe_{14}B$ magnets. One advantage of metal-metal matrix composite magnets over polymer-bonded magnets is temperature resistance. Polymer-bonded magnets are limited to service temperatures which will not exceed the limits of what the polymer can withstand. The temperature limit for polymer-bonded systems is either the softening point of the polymer or when oxygen diffusion becomes possible. Most polymers with sufficient fluidity to be formed with a heavy loading of solids cannot be used in air at above 150° C. An epoxy polymer, for example, at 100° C. allows oxygen permeation to the metal magnetic materials which begins to corrode and lose its magnetic properties.

In a metal-metal matrix composite magnet, the upper limit for service temperature is set by the magnetic alloy in the magnet. For $Nd_2Fe_{14}B$, the ultimate upper limit for service temperature is the Curie temperature ($T_c$) at about 310° C. With $Nd_2Fe_{14}B$, as with any permanent magnet, when it is heated to $T_c$, all remnant magnetism is lost. While the crystalline anisotropy is retained, the domains seek their lowest energy alignment. In the absence of an externally applied magnetic field, this alignment invariably has equal numbers of dipoles directed in each crystallographically allowed direction. This results in no net magnetic moment. On a practical basis, the maximum operating temperature will be less. This occurs because both the magnetization and coercivity of the $Nd_2Fe_{14}B$ have significant negative temperature factors. As a result, when such a magnet is in service, the unit containing it will start to lose power at a lower temperature, a temperature far below the Curie temperature.

Another advantage of metal-metal matrix composite magnets over polymer-bonded magnets is in maximum achievable power product. Polymer-bonded magnets are rarely able to achieve power products over 8 MGOe. In metal-metal matrix composite magnets a higher fraction of magnetic material, typically 90 vol%, is present in the metal bonded magnets. A polymer-bonded magnet loaded to the same volume fraction as a metal-metal matrix bonded magnet would be close to a 98 wt% magnetic material. A two weight percent bond phase in a polymer-bonded magnet is not likely to give very strong bonding.

Yet another advantage of a metal-metal matrix composite magnet is its corrosion resistance to organic solvents and moisture. For example, over a life span of 10 or 20 years, a permanent magnet motor can have many opportunities for exposure to materials such as lubricants, lubricant carriers, grease solvents, and paint solvents. Any of these materials have the potential to deteriorate the plastic in a polymer-bonded magnet which can lead to failure. On the other hand, none of these materials will have any effect on a metal-metal matrix composite magnet.

A metal-metal matrix composite magnet has better moisture resistance than a $Nd_2Fe_{14}B$ sintered magnet because most of the outer surface of a metal-metal matrix composite magnet is, for example, either copper, cobalt, or nickel and none of these elements are oxidized by water. Thus, moisture alone will have little effect on the magnet. Any deterioration of a metal-metal matrix composite magnet will be comparable to, or less than what would occur with a polymer-bonded magnet.

Metal-metal matrix composite magnets, however, are susceptible to attack by mineral acid or other electrolytes. Any $Nd_2Fe_{14}B$ magnet will be damaged by exposure to oxidizing acid such as $HNO_3$ or $H_2SO_4$. A polymer-bonded magnet will suffer the least amount of acidic corrosion because, once the metal in the top layer is dissolved, the rate of attack will drop sharply. A metal-metal matrix composite magnet, by its bimetallic nature, is more susceptible to electrolytic corrosion than a sintered magnet. It is recognized, however, that any magnet may be protected by coating the final fabricated magnet or part with a corrosion resistant layer.

There is a growing interest in the magnet industry in producing metal-metal matrix composite magnets, as an alternative to pure $Nd_2Fe_{14}B$ magnets and polymer-bonded magnets. It is known, for example as disclosed in Japanese Patent No. 62-137809, to produce a metal matrix-bonded neodymium-iron-boron alloy magnet by mixing a metal powder such as copper, aluminum, zinc or lead powder as a bond phase with a fine powder of the alloy magnetic material. The metal/magnetic material powder mixture is compression molded and then sintered to form a magnet of a specified shape. In this known process a layer of metal (bond phase) is not chemically deposited on the surface of the magnetic material to produce the bond, but the process simply involves physically mixing a magnetically inert metal powder and a magnetic metal powder. The resulting mixed powder is then sintered. A disadvantage of the above known process is that a power product of less than 6 MGOe is obtained. With respect to use of low-melting (i.e. <400° C.) metals such as lead, a metal-metal matrix composite magnet fabricated with such low melting metal may suffer loss of physical strength during its fabrication or its use due to its low softening point which may be reached before its Curie temperature.

There are numerous other known processes in which a fully formed magnet is plated or coated with copper or other metal for corrosion prevention, but none of the processes use the plating or coating step to actually bond the magnet.

It is desired to provide a process for producing metal-metal matrix composite magnets including chemically depositing a metal (bond phase) onto the surface of a magnetic material.

It is further desired to carry out a process for preparing the composite magnets at low process sintering temperatures such as less than 400° C. and low plating temperatures such as from about −10° C. to 20° C. Low operating temperatures mean less expensive equipment for a production facility.

SUMMARY OF THE INVENTION

One aspect of the present invention is directed to a composition of a metal-metal matrix composite magnet comprising a neodymium-iron-boron magnetic phase bonded by a metal matrix, preferably copper.

Another aspect of the present invention is directed to a process for producing a metal-metal matrix composite magnet including depositing a metal layer onto at least a portion of the surface of a plurality of particles of a magnetic material; forming a shaped body from the particles; and heating said shaped body sufficient to sinter the particles together whereby a metal-metal matrix composite magnet is formed.

The process of the present invention advantageously may be used for producing an all-metal bonded magnet under relatively mild conditions. The all-metal magnets of the present invention have higher maximum service temperatures and are generally higher powered than polymer-bonded magnets.

DETAILED DESCRIPTION OF THE PREFERRED EMBODIMENT(S)

The term "metal-metal matrix composite" herein means a mixture of two independent and discrete metallic materials. One of the metallic materials referred to as the matrix is present as the continuous phase and provides the bonding for the composite. The other metallic material is considered the discontinuous phase and is present largely as particles surrounded by the matrix. This does not preclude the possibility of contacts between particles of the discontinuous phase. A metal-metal matrix composite is different from an alloy or a solid solution in that each metallic material in the composite retains its own chemical properties, crystalline structure, and microphysical properties. On a macroscopic scale, the composite has a new set of properties, which are a combination of the components in the composite.

In the present invention, a magnetic material such as $Nd_2Fe_{14}B$ represents the major component of the product magnet, on both a mass and a volume basis. It is, however, treated as the discontinuous phase. As noted above, this does not mean that each piece is isolated from every other. At the concentrations used, many contacts are expected, but not enough to establish a continuous network.

The continuous or matrix phase of the product composite magnet is generally a metal softer than the discontinuous phase such as copper, nickel, or cobalt. While the amount present of the continuous phase in the product magnet is less than the discontinuous phase, the method of fabrication of the present invention preferably provides a continuous phase present around and between the magnetic material particles. The metals selected as the continuous phase are generally selected, for example, because of their ease of reduction from solution and their malleability.

Ease of reduction from solution is important because the simplest way of evenly and uniformly coating the outside of a large number of tiny particles at once is to disperse those particles in a fluid containing the coating. When the material is fully dispersed, all of the outside surface is in contact with the coating medium. If the coating is a metal, and the coating operation is to be carried out below the coating's melting point, one practical approach is plating from a solution. To be successful, it is necessary to reduce the metal ion without using a system that corrodes the magnetic phase. The choise of reductants, therefore, should be to materials which are either already in the system or reducing agents which are not reactive towards the magnetic material.

Malleability is important for developing a final composite bond. The desired forming method is pressing or rolling at ambient temperature. The composite parts are produced by pressing the hard grains, coated with soft metal, together until the coatings bonds with itself, and flows out from between close approach points of the grains to fill the interstitial voids.

In accordance with the present invention a metal-metal matrix composite magnet is produced comprising a dense assembly of small, for example less than 18 microns, particles of magnetic material such as $Nd_2Fe_{14}B$ bonded together by a continuous phase of a metal softer than the magnetic material. Suitable magnetic material used in the present invention include $Nd_2Fe_{14}B$ and its derivatives such as $Dy_2Fe_{14}B$ and $Nd_xDy_{(2-x)}Fe_{14}B$.

Cobalt may be substituted for all or part of the iron in the neodymium-iron-boron phase of the magnet. Other rare earth metals, such as, but not limited to, cerium, dysprosium, erbium and yttrium may be substituted for all or part of the neodymium. Part or all of the boron may be replace by carbon. Other metals or nonmetals may be substituted for small portions of either the iron or the neodymium. The relative proportions of the neodymium, iron, and boron may be varied slightly. Some of these changes may improve the magnetic properties of the alloy. All of the above changes and variations to the magnet are within the skill of the artesian and are described, for example, in *Nd-Fe Permanent Magnets: Their Present and Future Applications*, edited by I. V. Mitchell, Elsevier, N.Y., 1985.

The softer metal used may be any metal which is known to have good ductility and may include, for example, copper, cobalt, nickel, tin, lead, mercury, silver, gold, palladium, iridium, rhodium, rhenium, bismuth, and platinum. Copper, cobalt, and nickel are the preferred softer metals used in the present invention because of their abundance and availability as highly pure compounds and because of their corrosion resistance. Tin and silver are the next preferred softer metals used in the present invention because of their availability. Tin is generally lower melting and silver compounds are generally less soluble.

The amount of softer metal bonded to the $Nd_2Fe_{14}B$ phase should be sufficient to physically hold the $Nd_2Fe_{14}B$ phase together and provide a strong part. The amount of softer metal used should, however, not be so much that the magnetic properties of the $Nd_2Fe_{14}B$ are adversely affected such as adversely reducing magnetic strength. The amount of softer metal used may preferably range from about 4 to about 15 volume percent of the bonding phase and more preferably from about 6 to about 10 volume percent.

The particles of the softer metal are preferably less than about 0.8 microns in size and more preferably less than about 0.5 microns in size.

In its broadest scope, the method of the present invention includes chemically depositing a metal onto at least a portion of the surface of fine particles of a magnetic material such as powdered $Nd_2Fe_{14}B$ by using, for example, a metal plating solution. The plated powder is then pressed into a specified configuration. Thereafter, the pressed configuration is sintered at a temperature of less than about 400° C.

The particles of magnetic material are preferably less than about 18 microns in size and more preferably from about 2 microns to about 10 microns in size.

The plating solution is preferably a non-aqueous solution of a metal halide in a non-aqueous solvent. The metal halide salt may include, for example, chloride or bromide salts. For example, when plating copper onto magnetic particles, $CuCl_2$ or $CuBr_2$ in a non-aqueous solvent may be used. It may also be possible to use other salts with non-oxidizing anions, but in general, these salts have solubilities in a solvent such as alcohol which are too low for practical use.

The metal halide salt present in the non-aqueous solvent may be at a concentration of from about 1 weight percent (wt%) to about 40 wt% and preferably from about 3 wt% to about 12 wt%. If the maximum concentration of the metal halide salt in the solvent is exceeded, an exotherm on plating produces too large of a temperature rise and below the maximum concentration the solution volume becomes too large.

The non-aqueous solvent used should be sufficient to solubilize the above preferred salts. The non-aqueous solvent used in the solution includes, for example, alcohols such as ethanol, butanol, and propanol. Solubility testing indicates that i-propanol and i-amyl alcohol (3-methyl butanol) have sufficient solvating ability towards $CuCl_2$ to work. Other alcohols may also work, but decreasing $CuCl_2$ solubility will require large solution volumes, rendering them less convenient. For example, copper can also be plated from acetone but solubility of copper in acetone is poor.

Using the plating solution, a thin metal layer, for example, a layer having a thickness of less than 1000 angstrom average and preferably less than 500 angstrom average, is plated from the non-aqueous solution onto the surface of the magnetic particles (magnetic phase). The plating is preferably carried out at a temperature of from about −20° C. to about 30° C. and more preferably from about −10° C. to about 10° C. The plated powder is then pressed, with or without magnetic alignment, into a desired shape. Sintering of the shaped body is then carried out at a temperature below about 400° C.

The pressing step is carried out by conventional methods. For example, uniaxial pressing, rapid omnidirectional compaction, isostatic pressing and hot isostatic pressing may be used as methods for fabrication. Generally, a fully densified, i.e., a completely solid, totally pore-free part is desired after pressing. The densities achieved by the pressing method may range above about 80% and preferably above about 90% of the theoretical value for a completely solid, totally pore-free part. Generally, a part having less than 80% theoretical density will be unstable in air, i.e., the magnetic material will be susceptible to oxidation.

The sintering temperature for use in the present invention is preferably below about 400° C. and more preferably from about 325° C. to 375° C. At temperatures higher than about 400° C. the metal used as the bonding phase may diffuse into the magnetic phase and degrade the magnet. At temperatures lower than about 300° C. sintering does not satisfactorily occur at ambient pressure.

An object of the fabrication of the magnets of the present invention is to produce as strong a magnet as possible. Although physical strength is a beneficial feature, the most important strength is the magnetic strength. Magnetic strength is defined as the power product, (BH)max, of the magnet, as determined by measuring its hysteresis loop. Generally, the product magnets of the present invention have a (BH)max of above about 4 MGOe. More often, the (BH)max of the product magnets is above about 6 MGOe, preferably above about 10 MGOe and more preferably above about 12 MGOe.

When the product magnets produced by the process of the present invention is used in corrosive environments such as moist air applications or wet or salty environments, the magnets may be coated with a conventional corrosive protection coating by well known techniques.

In carrying out one embodiment of the present process, a hydrogen decrepitated metal is preferably wet milled in an inert solvent such as xylene. Other inert solvents could be used for the milling, as long as they are not reactive toward the magnetic alloy. For example, benzene, toluene, octane, and decane may be used as the solvent. Some considerations for choosing xylene, more specifically mixed isomers of xylene, over the other solvents listed above include xylene's lower toxicity compared to benzene, xylene's higher flash point compared to benzene, toluene and octane, and xylene's lower price compared to octane and decane. While neither wet milling nor hydrogen decrepitation are required steps in this invention, the wet milling and hydrogen decrepitation steps are employed herein as an expedient since these steps have been found to be easy techniques commonly used in the art as described in the following publications: *The Production of a Nd-Fe-B Permanent Magnet by a Hydrogen Decrepitation/Attritor Milling Route,* by P. J. McGuiness, I. R. Harris, E. Rozendaal, J. Ormerod, and M. Ward., Journal Mat. Sci 21, pp. 4107–10, 1986 and *Oxidation of Fe-R-B Powders During Preparation of Permanet Magnets,* by C. N. Christodoulon, J. Schlup and G. C. Hadjipanyis, Journal Appl. Phys. 61 (8), pp. 3760–2, 1987.

The plating solution and the magnetic material in solvent dispersion are thoroughly mixed together. It is important, in carrying out the present invention, to rapidly and thoroughly disperse the magnetic material such neodymium-iron-boron in the solution of the metal to be plated. This is especially important in the case where copper is used as the metal bonding phase where the reaction takes less than a minute. Incomplete mixing leads to uneven plating. By first dispersing a fine powder of the magnetic material such as $Nd_2Fe_{14}B$ in a liquid which is compatible with the solvent system, the mixing can be rapid and complete.

After the plating solution and magnetic material/solvent dispersion have been mixed, the mixture is filtered and dried. A metal plated product results and is ready to form into a magnet. A magnet shape is formed by a conventional pressing technique as aforementioned. The formed magnet material is then sintered as described above.

In copper and nickel systems, for example, all yields are quantitative through plating. Losses after drying, such as during removal from the filter and fabrication, are largely dependent on an operator's skill. A skilled worker can recover 99% from the filter and, with a simple shape, have a similarly low loss in pressing. With more complex shapes, the losses may be greater.

Using the process of the present invention advantageously high powered magnets under mild conditions can be produced. Metal matrix bonding means the maximum service temperature for the magnet is set by the magnetic phase, not the bond phase as in a polymer-bonded magnet. At about 80% of theoretical density (partially pressed, but not fully densified), the magnets are easily machined with conventional metal working tools. This allows the mass production of generic-shaped blanks for final custom machining for applications. Short runs of a product design are feasible.

At full density, while the magnets are machinable, the magnets exhibit great toughness which indicates that parts made of such magnets will not quickly wear out in service.

EXAMPLE 1

Copper-Bonded Magnets

A 75 gram (g) sample of Magnaquench brand $Nd_2Fe_{14}B$, which had previously been processed by hydrogen decrepitation to reduce the particle size and introduce microfractures, was milled for 45 minutes as a xylene suspension using a 700 ml jar and mixed $\frac{1}{8}''$ and $\frac{1}{4}''$ steel balls. The resulting slip was separated from the media with a typical recovery of 95%. Excess xylene was decanted and the slip set aside. The size of the $Nd_2Fe_{14}B$ was under 53 microns.

A 16.2 g sample of $CuCl_2$ was dissolved in 205 ml anhydrous ethyl alcohol, which had been further dried by storing with 3 A molecular sieves for at least 24 hours.

The $CuCl_2$ solution, the $Nd_2Fe_{14}B$/xylene slurry and about 200 ml of additional dried ethanol were cooled to less than 0° C.

The $CuCl_2$ solution was added to the xylene slurry and the mixture shaken vigorously until it exothermed and the mixture's moss-green color disappeared to be replaced by a muddy-coppery color of a plated alloy.

Gas evolution was observed.

While the difference in standard potentials between copper and iron are sufficient to cause the simple replacement of iron by copper according to the following equations:

$$\text{Cu half reaction } Cu^{+2} + 2e^- \rightarrow Cu^{\circ} + 0.337v$$

$$\text{Fe half reaction } Fe^{\circ} - 2e^- \rightarrow Fe^{+2} + 0.440v$$

$$\text{net } Cu^{2+} + Fe^{\circ} \rightarrow Cu^{\circ} + Fe^{2+} + 0.777v$$

it is believed that when the plating is carried out in alcohol, the alcohol participates as a reducing agent to reduce the copper. This novel reaction is described in Example 2.

The plated alloy was immediately separated from the spent plating solution by vacuum filtration and washed with dried ethanol. After extracting as much fluid as possible by vacuum filtration, the remaining solvent was removed by vacuum evaporation at 20° C. and less than 1 torr total pressure.

The entire procedure (decrepitation, milling, and plating) as well as all subsequent manipulations were carried out with oxygen and water rigorously excluded.

Initial compaction of the plated material was accomplished with a Spex Industries 31 mm evacuable die and a 19-ton load. A pellet (about 78% dense) formed by the compaction equipment was sealed in a polytetrafluoroethylene packet. The sealed pellet was then heated to 250° C., loaded into a silicone rubber container, and densified by rapid omni-directional compaction to above 95% of theoretical density.

After poling, the resulting magnet had a power product of 13.9 MGOe.

EXAMPLE 2

Copper-Bonded Magnets

The following example was carried out using a different alcohol as a solvent and to determine the extent of the alcohol's involvement in the reaction product. A slip consisting of 23.4 g of $Nd_2Fe_{14}B$ dispersed in approximately 33 g of xylene was produced as described in Example 1.

A 6.0 g of $CuCl_2$ was dissolved in 90 ml of n-butyl alcohol which had been dried with 3 A molecular sieves for over 24 hours.

The $CuCl_2$ solution was added to the $Nd_2Fe_{14}B$ slurry and mixed by shaking. Within one minute, the green color had disappeared from the solution and the alloy had gone from black to coppery-brown in color, with the evolution of heat and gas. The plated alloy was separated from the clear solution by filtration and the solution retained. After washing with additional dried butanol, the alloy was dried at 20° C. and less than 1 torr total pressure. The free flowing powder was suitable for magnet fabrication by compaction.

Analysis of the plating solution by GC-MS revealed the presence of four $C_4$ compounds not present in the starting solvents and an apparent increase in a fifth compound. The new compounds were all 3 butene isomers and butane. The apparent increase was in the amount of butaldehyde present. This conversion indicates an involvement of the alcohol in the reaction. The key to this reaction's occurrence was the alloys affinity for hydrogen, which furnishes the driving force to begin the conversion.

EXAMPLE 3

Copper-Bonded Magnets

A 50 g sample of Magnaquench brand of $Nd_2Fe_{14}B$ was processed and plated as described in example 1 using 10.8 g $CuCl_2$ dissolved in 137 ml ethanol. Densification was accomplished by unaxial pressing, with sintering at 350° C. to 79% of theoretical density. After poling the resulting magnet had a power product of about 8.3 MGOe.

EXAMPLE 4

Nickel-Bonded Magnets

Although anhydrous nickel (II) chloride ($NiCl_2$) was available commercially, a very easily dissolved form can be produced as follows: Disperse 20.0 g $NiCl_2.6H_2O$ in 400 g reagent grade acetone. Allow to stand with occasional stirring for 24 hours or longer; then, with the nickel chloride completely settled to the bottom, replace about 90% of the acetone. Repeat standing and stirring and replace the acetone with acetone previously dried over molecular sieves. After another stirring and standing cycle, the acetone was decanted from the now anhydrous nickel chloride.

This drying process, which can be followed by observing the change in color of the nickel chloride from bright green to light yellow, relies on the following equilibrium:

$$NiCl_2.6H_2O + acetone \rightleftharpoons NiCl_2 + 6H_2O \text{ (acetone)}.$$

Although the equilibrium in this reaction favors the right-hand side when acetone was in excess, it takes the repeated removal of the water dissolved in the acetone to push the reaction completely over.

A nickel chloride prepared as described above was dissolved in 215 ml ethanol which had been dried with molecular sieves. A slip produced by milling 55 g of $Nd_2Fe_{14}B$ in xylene, as described in Example 1 above, was combined with the nickel chloride solution in a jar and mixed by constant rolling for about 10 minutes, at which time the green color of the nickel disappeared. The plated alloy was removed by vacuum filtration in an inert atmosphere, washed with an additional increment of dried ethanol, and dried at room temperature and a vacuum of less than 1 torr.

Magnets were fabricated by pressing the powder by standard uniaxial pressing. The resulting magnet had a power product of about 4.3 MGOe.

EXAMPLE 5

Cobalt-Bonded Magnets

Although anhydrous cobalt(II) chloride ($CoCl_2$) was commercially available, another route was used in this example.

Thirty grams of $CoCl_2.6H_2O$ was dissolved in 279 grams of acetone. The red hexaaquocobalt(II) ion immediately converts to a blue tetrahedrally coordinated form, most likely $CoCl_2.2$(acetone), via the following reaction:

$$Co(H_2O)_6Cl_2 + (x.s.)acetone \rightarrow CoCl_2.2(acetone) + 6\text{-}H_2O(acetone)$$

The driving force for this is the preference of cobalt for coordination by the donor solvent (acetone). The water was removed from the solution by absorption onto Co exchanged typed A zeolites.

After removing the zeolites by vacuum filtration, the solution was combined with a slip produced from 75 grams of $Nd_2Fe_{14}B$ as described in Example 1. The mixture was kept mixed by rolling in a jar for about 16 hours, the plated alloy removed by vacuum filtration in an inert atmosphere and washed with dried acetone. Drying was carried out at 20° C. and less than 1 torr total pressure.

Unlike the copper and nickel system, all of the color does not disappear from the cobalt solution. After about 16 hours, the intensity of the blue color has been reduced significantly. Additional contact time does not lead to any further reduction in the color's intensity.

Magnets were fabricated by pressing the plated powder by standard uniaxial pressing. The resulting magnet had a power product of about 5.0 MGOe.

What is claimed is:

1. A process for producing a metal bonded magnet composite, said process comprising:

depositing a metal layer onto at least a portion of the surface of a plurality of particles of a magnetic material:

forming a shaped body from the particles; and heating said shaped body sufficient to sinter the particles together whereby a metal-metal matrix composite magnet is formed, wherein said magnetic material comprises a phase of NdFeB;

said deposited metal layer comprises a nonmagnetic ductile metal, said deposition being performed by chemical-plating of dissolved ductile metal onto the magnetic particles in a non-aqueous medium.

2. The process of claim 1 wherein the metal chemically plated onto the particles of magnetic material is at least one selected from the group consisting of copper, cobalt, nickel, tin lead, mercury, silver, gold, palladium, iridium, rhodium, rhenium, bismuth, and platinum.

3. The process of claim 1 wherein the shaped body is formed by a pressing process.

4. The process of claim 3 wherein the pressing is carried out by uniaxial pressing.

5. The process of claim 3 wherein the pressing is carried out by rapid omnidirectional compaction.

6. The process of claim 1 wherein the heating is carried out at a temperature of less than about 400° C.

7. The process of claim 1 wherein the heating is carried out at a temperature of from about 300° C. to less than about 400° C.

8. The process of claim 1 wherein the plating is carried out at a temperature of from about −20° C. to about 30° C.

9. The process of claim 1 wherein the plating is carried out at a temperature of from about −10° C. to about 10° C.

10. The process of claim 1 wherein the layer of ductile metal is less than about 1000 angstroms in thickness.

11. The process of claim 1 wherein the layer is less than about 500 angstroms in thickness.

12. The process of claim 1 including the step of coating the sintered shaped body with a corrosive protection coating.

13. The process of claim 1 wherein the metal layer is selected from copper, nickel and cobalt.

14. The process of claim 1 wherein the magnetic material is $Nd_2Fe_{14}B$.

15. The process of claim 1 wherein the magnetic material particles are less than about 100 mesh in size.

16. The process of claim 1 wherein the magnetic material particles are less than about 270 mesh in size.

17. A process for producing composite metal bonded magnets comprising:

chemically plating a ductile metal layer onto the surface of a magnetic powder material comprising NdFeB by using a non-aqueous solution containing at least one metal of the group consisting of copper, cobalt, nickel, tin, lead, mercury, silver, gold, palladium, iridium, rhodium, rhenium, bismuth, and platinum:

pressing the metal-plated powder into a desired shape; and sintering the pressed powder at a temperature below about 400° C.

18. The process of claim 17 wherein the pressing step is carried out with magnetic alignment.

19. The process of claim 17 wherein the pressing step is carried out without magnetic alignment.

20. A composition for a metal bonded magnet comprising a dense assembly of $Nd_2Fe_{14}B$ particles bonded together by a continuous phase of a softer metal.

21. The composition of claim 20 wherein the softer metal is selected from copper, nickel and cobalt.

22. The composition of claim 20 wherein the softer metal is present in an amount of from about 4 to about 15 volume percent based on the amount of material used.

23. The process of claim 17 wherein the sintering is carried out at a temperature of from about 300° C. to less than about 400° C.

24. The process of claim 17 wherein the plating is carried out at a temperature of from about −20° C. to about 30° C.

25. The process of claim 17 wherein the plating is carried out at a temperature of from about −10° C. to about 10° C.

26. The process of claim 17 wherein the layer of ductile metal is less than about 1000 angstroms in thickness.

27. The process of claim 17 wherein the layer is less than about 5000 angstroms in thickness.

28. The process of claim 17 including the step of coating the sintered shaped body with a corrosive protection coating.

29. The process of claim 17 wherein the metal layer is selected from the group consisting of copper, nickel and cobalt.

30. The process of claim 17 wherein the magnetic material is $Nd_2Fe_{14}B$.

31. The process of claim 17 wherein the magnetic material particles are less than about 100 mesh in size.

32. The process of claim 17 wherein the magnetic material particles are less than about 270 mesh in size.

33. The composite prepared in accordance with claim 17.

34. The composite prepared in accordance with claim 1.

* * * * *